US007244237B2

(12) United States Patent
Smith

(10) Patent No.: US 7,244,237 B2
(45) Date of Patent: Jul. 17, 2007

(54) HEATED MASSAGE BALL

(76) Inventor: Floyd Thomas Smith, 1401 N. Kraemer Blvd., Suite B, Anaheim, CA (US) 92806

( * ) Notice: Subject to any disclaimer, the term of this patent is extended or adjusted under 35 U.S.C. 154(b) by 258 days.

(21) Appl. No.: 10/975,782

(22) Filed: Oct. 28, 2004

(65) Prior Publication Data

US 2006/0100558 A1 May 11, 2006

(51) Int. Cl.
*A61H 1/00* (2006.01)

(52) U.S. Cl. ..... 601/15; 601/18

(58) Field of Classification Search ..... 601/15, 601/18, 46, 49–55; 482/18, 132, 140
See application file for complete search history.

(56) References Cited

U.S. PATENT DOCUMENTS 3,752,155 A * 8/1973 Blinoff et al. ..... 601/19
5,027,795 A * 7/1991 Kato ..... 601/15
6,309,331 B1 * 10/2001 Raymond ..... 482/148

FOREIGN PATENT DOCUMENTS

DE 3905517 C1 * 2/1989
FR 2635974 * 3/1990

* cited by examiner

*Primary Examiner*—Michael A. Brown
(74) *Attorney, Agent, or Firm*—Clement Cheng

(57) ABSTRACT

A heated massage ball apparatus has a ball that may be heated retained within a grip that allows for the ball to rotate freely therewithin. The ball may be heated, for example, in a microwave oven, and may be substantially hollow and filled with a liquid that retains heat. The grip is pliable enough to allow the forced insertion or ejection of the ball past its widest circumference. An opening in the bottom of the base may facilitate the removal of the ball from the base, whereby the user inserts a finger therein to force the ball out of the grip. A heating base can accept the grip and ball and provide heat to the ball, such as a heated conductor that extends through the bottom opening in the grip and heats the ball by direct contact and thermal conduction. An electrical circuit may be included that provides on/off and temperature controls, a heating element, a temperature-sensing means, a thermostat, and a display for indicating a target and current ball temperatures.

11 Claims, 3 Drawing Sheets

HEATED MASSAGE BALL

FIELD OF THE INVENTION

The present invention relates generally to massage devices and, more particularly, to a heated massage ball.

DISCUSSION OF RELATED ART

Massage devices are well known in the prior art, some taking the form of round or spherically-shaped implements that can be pressed against a user's back to create a pleasurable sensation. For example, U.S. Pat. No. 754,925 to Zar-Adusht-Hanishon Mar. 15, 1904, discloses a massage ball device that partially encloses a massage ball in a shell that can be gripped by the user. The ball in such a device moves freely within the shell when the ball is pressed and moved against a patient's body. However, such a device is preferably made from wood, and as such does not provide for heating of the ball of the device, which can be of benefit to the patient.

A very early example of a ball massager is taught in Design Pat. No. 143,678. Design Pat. Nos. 262,908; 264,754; 269,376 and 444,483, also disclose various hand-held ball massagers, but with multiple balls as the contact points. Inventor York in Design Pat. Nos. 454,644 and 469,880, discloses more recent hand-held massaging devices with single balls as the massage contact points. Inventor Racoosin in U.S. Pat. No. 6,093,159 teaches a freely rotational ball massager that is designed to fit more comfortably in a therapist's hand to prevent hand strain. Inventor Wu in U.S. Pat. No. 5,413,551 discloses a spherical massage device that is hand-held and includes an internal vibration generator that appears to be battery operated. Inventor Obagi in U.S. Pat. No. 5,131,384 discloses a ball massager that combines as an applicator to apply fluid (such as massage oil) as the massage is performed. Inventor Bontemps in U.S. Pat. No. 5,127,395 discloses a spherical device containing a eutectic cooling mixture at −20 C that is specifically beneficial to the skin of the person being massaged.

Since the '925 patent, other massage devices have been introduced that utilize a ball contained within a shell or grip. For example, U.S. Pat. No. D403,076 to York on Dec. 22, 1998, discloses such a device. Massagers have also been made that combine both the mechanism of vibration and infrared heat. Inventor Cheng in U.S. Pat. No. 5,336,159 discloses a device with two vibrating rubber massage elements that are heated by infrared heat. Inventor Kim in U.S. Pat. No. 5,176,130 also discloses a device that is electrically heated with a vibration mechanism.

OBJECTS OF THE INVENTION

Other heated devices in the prior art used for massage typically do not include a warmed ball that can be rolled along the patient's body, which is a relaxing and beneficial effect. Thus, there is a need for an improved massage device that provides for a rolling ball or the like that may be heated for additional therapeutic effect. Such a needed device would be easy for the user to use and heat, and would be relatively inexpensive to manufacture. Such a device would work with or without the presence of massage oil or the like, and would not make any harsh or otherwise irritating regular noises during heating, thereby promoting a relaxed atmosphere for the patient. The present invention accomplishes these objectives.

SUMMARY OF THE INVENTION

The present device, in its simplest form, is a ball that may be heated and that is retained within a grip that allows for the ball to rotate freely therewithin. The ball may be heated in, for example, a microwave oven, and may be substantially hollow and filled with a liquid that retains heat. As such, upon heating, the ball may be inserted into the grip, which extends slightly past the center of the ball so as to frictionally retain the ball during use. The grip is preferably plastic or rubber and pliable enough to allow the forced insertion or ejection of the ball past its widest circumference. An opening in the bottom of the base may facilitate the removal of the ball from the base, whereby the user inserts a finger therein to force the ball out of the grip.

Alternatively, a heating base may be included for accepting the grip and ball and to provide heat to the ball by a variety of means. For example, a heated conductor may be included in the base that extends through the bottom opening in the grip when the grip is engaged in the base. Such a heated conductor heats the ball by direct contact and thermal conduction. An electrical circuit includes a thermostat that measures the temperature of the ball and determines if the instant temperature of the ball has reached or exceeded a user-set target temperature. The circuit may power the heated conductor. The electric circuit may be AC or DC powered, and may include a display for indicating the target and current ball temperatures.

In an alterative embodiment of the invention, an inductor coil may be included in the grip for heating of the ball. In yet another embodiment of the invention, water or massage oil or another liquid may be heated in a depression of the base such that when the grip and ball are engaged in the base, the fluid heats the ball by conduction.

In use, a masseur applies power to the device or otherwise heats the ball to a desired temperature. The masseur then grasps the grip while rolling the ball around on the patient's skin as desired. In this manner, heat from the ball is transferred to the patient while the force of the ball against the patient's skin creates a pleasurable massage feeling and provides other therapeutic benefits. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 2:
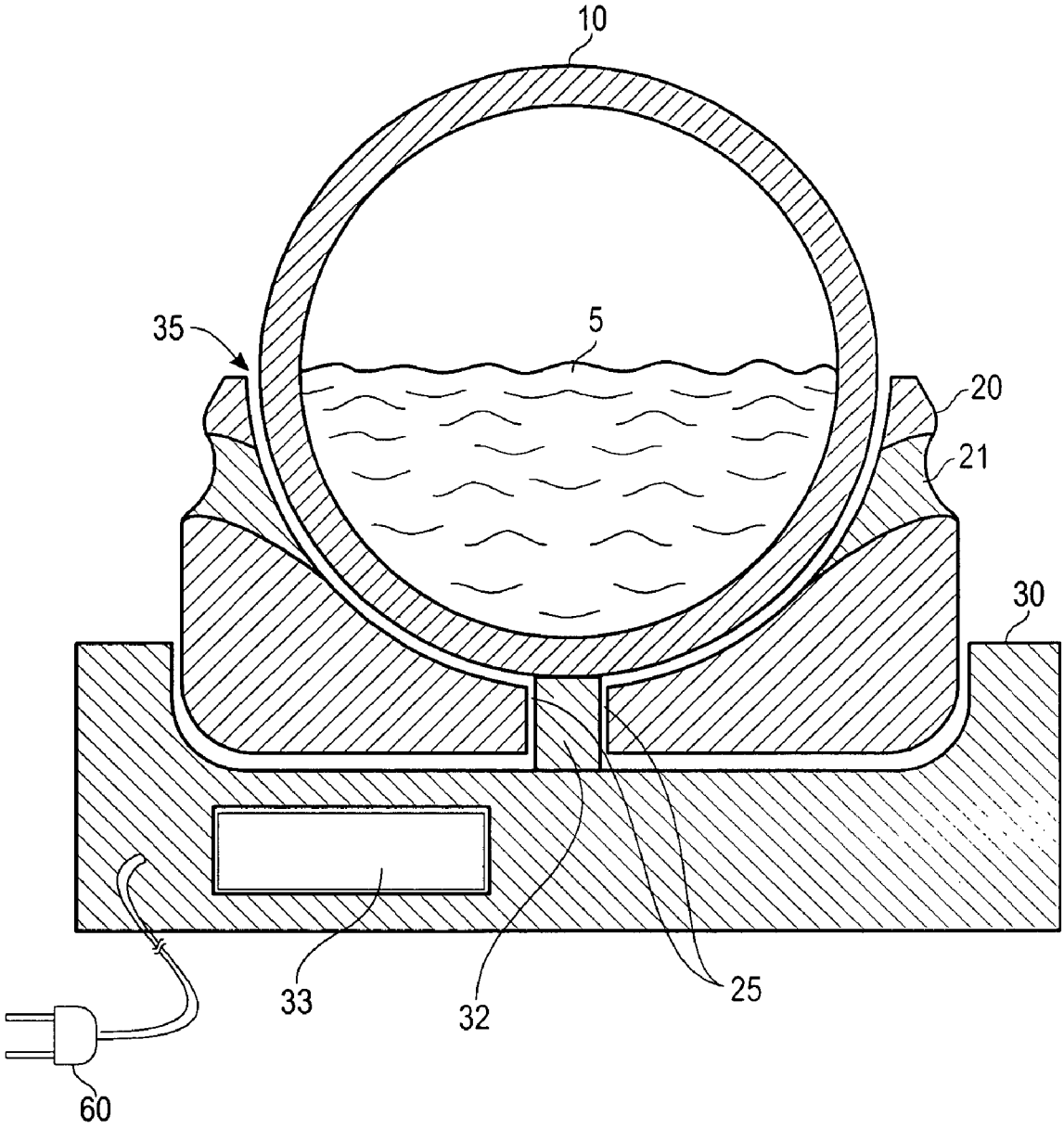
FIG. 2 is a cross-sectional view of the invention, taken generally along lines 2-2 of FIG. 1, illustrating a heated liquid inside the ball of the invention.
Figure 3:
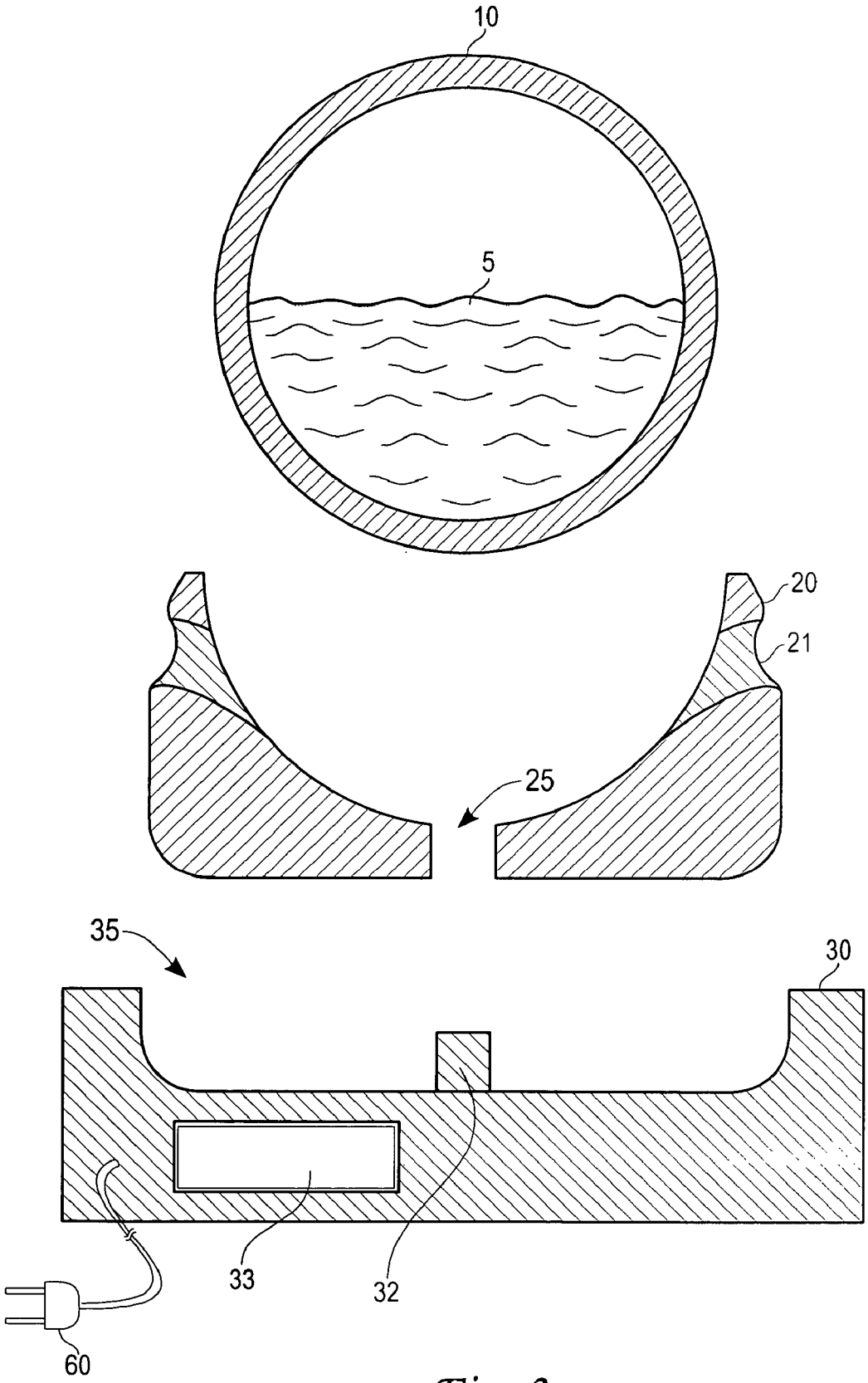
FIG. 3 is an exploded cross-sectional view of the invention, illustrating the assembly thereof.

The present invention is a heated massage ball apparatus comprising a spherical, rigid ball 10 that, in the simplest embodiment is hollow and contains a heatable fluid 5 therein (FIG. 3). The fluid 5 in the ball 10 may be heated in a microwave oven, for example, and in such an embodiment the ball 10 is made from a rigid microwave-safe polymer that is also easily washed. The fluid 5 may be a viscous oil or other type of fluid that retains heat for an extended period of time. A grip 20 is included that retains the ball 10 therein yet allows the ball 10 to rotate freely therewithin. The grip 20 is preferably made from an easily gripped rubber or plastic material that results in little friction between the grip 20 and the ball 10 (FIG. 2) and that, like the ball 10. is easily washed and cleaned. The grip 20 includes a bottom opening 25, FIG. 2, or side opening 22, FIG. 1 to eject the ball 10 from the grip 20 by insertion of a finger or other implement (not shown) while holding the grip 20 firmly. In case of using a side opening 22, an additional bottom opening can also be added but need not be human digit sized.

In an alternate embodiment of the invention, a heated base 30 is included that accepts the grip 20 thereon for heating of the ball 10. A heated conductor 32 may be included on the base 30 such that when the grip 20 with the ball 10 is engaged with the base 30, the heated conductor 32 is inserted into the bottom opening 25 of the grip 20 to contact the ball 10 for heating. The base 30 may include a base depression 35 (FIGS. 2 and 3) for receiving the grip 20 therein to provide for proper position of the heated conductor 32 into the bottom opening 25 of the grip 20. The base depression is optionally filled with water to facilitate heat transfer and control temperature ranges.

Optionally, the base depression 35 is at least partially hemispherical shaped so that it can also receive the ball directly without the ball housing. In this option, a user ejects the ball from the housing, and puts the ball into the base depression for heating. After the ball is heated, the user takes the ball and replaces it back into the socket of housing 20 for use.

Figure 1:
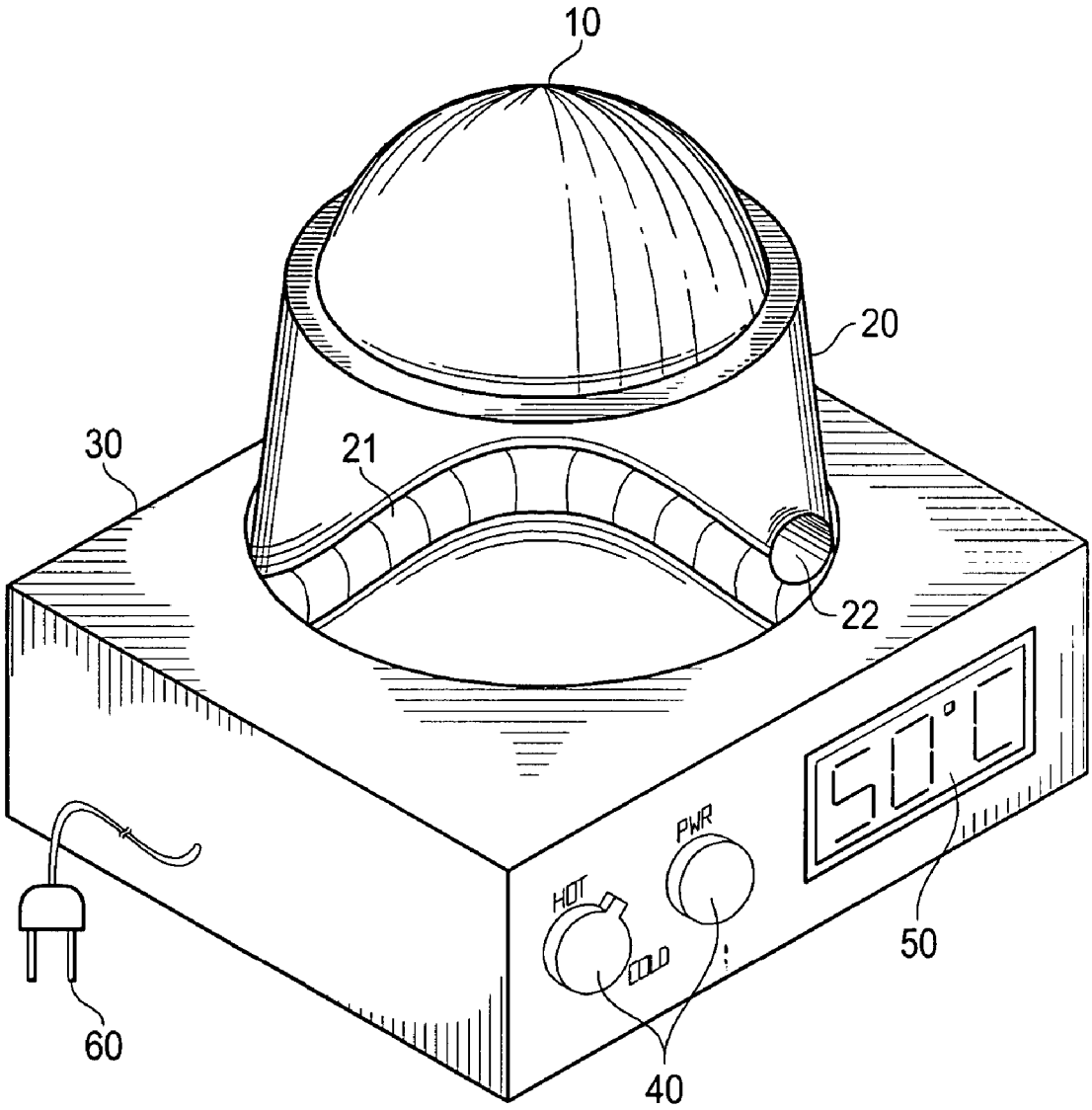
FIG. 1 is a perspective view of the invention, illustrating a massage ball, a grip, and a heated base of the invention.

The base 30 may further include an electric circuit 33 (FIG. 2) that receives power from a power cord 60 and that is electrically connected to controls 40 and a heating element 36 within the heated conductor 32 such that the heated conductor 32 is electrically heated. A display 50 may be included for displaying a target temperature of the ball 10 and the current temperature of the ball 10. As such, the user can adjust the controls 40 so as to set the target temperature of the ball 10, and then read the display 50 to know when the ball 10 has reached the target temperature. The controls 40 may include a knob for setting the target temperature and a power switch for turning the electric circuit 33 on or off (FIG. 1). The power cord 60 may be an AC power cord for insertion at one end into a standard AC outlet, or a low-voltage DC powered receptacle for receiving DC power from a standard 12 volt AC/DC adapter.

The circuit 33 may further include an audio transducer (not shown) that emits a chime or other low-volume pleasant sound that alerts the user when the current ball temperature has reached the target temperature. The circuit 33 may further include a temperature-sensing means 38, such as a thermocouple or thermistor, located distally from the heated conductor 32, such as in an edge of a lip of the grip 20 that contacts the ball 10, so as to provide information about the instant temperature of the ball 10. The thermocouple may be electrically connected to the circuit 33 through contacts located on the bottom of the grip 20 that touch corresponding contacts in tie depression 35 of the base 30 (not shown) when the grip 20 and the ball 10 are engaged with the base 30. The circuit 33 may further include a thermostat as is common in the prior art for automatic control of the heating element 36 so that the temperature of the ball is maintained at or near the target temperature.

In an alternate embodiment of the invention, the depression 35 in the base 30 may be filled with water, the water being heated by a heating element 36 may be included in the base depression 35 (not shown). As such, when the grip 20 with the ball 10 is inserted into the base depression 35, the water flows up through the bottom opening 25 of the grip 20 to contact and heat the ball 10. As such, the heating element 36 does not directly contact the ball 10. In such an embodiment, the ball 10 may be made of a metal or other highly thermoconductive material. Further, the ball 10 in such an embodiment may be solid and not filled with the liquid 5, and not for heating in a microwave oven.

In yet another embodiment of the present invention, an induction coil 37 may be included within the grip 20 that heats the ball 10 when the induction coil 37 is electrically connected to the circuit 33 in the base 30 through contacts in the bottom of the grip 20 that electrically connect to contacts in the depression 35 of the base 30 (not shown). In such an embodiment, water is not used in the depression 35 of the base 30, making the device easier and perhaps safer to use.

Preferably, the grip 20 is keyed or otherwise has an asymmetric shape so that the grip 20 may be inserted into the base 30 in only one orientation. As such, the electrical contacts for the temperature-sensing means 38 and the electrical contacts for the induction coil 37 contact the corresponding electrical contacts in the base 30 (not shown). Alternately, the contacts grip 20 may be circular in a planar view and the contacts for the temperature-sending means 38 and the induction coil 37 may be radially aligned with circular contacts in the base (not shown), thereby providing for contact between the sets of contacts independently of the radial orientation of the grip 20 within the base 30.

In use, a masseur begins to heat the massage ball 10 by switching on power and setting the target temperature by manipulating the controls 40 of the base 30. Upon seeing that the current ball temperature has reached the target temperature, or upon hearing a chime from the electrical circuit that indicates same, the masseur removes the grip 20 and ball 10 and, grasping the grip 20, rolls the ball 10 along the patient's skin as desired. The ball 10 freely rotates within the grip 20. In the event massage oil or other lubricant is used, the friction of the ball 10 against the patient's skin may be insufficient to induce a rotational force to the ball 10. However, the massage effect in such a situation is equivalent since heat from the ball 10 continues to be transferred to the patient's skin.

While particular forms of the invention have been illustrated and described, it will be apparent that various modifications can be made without departing from the spirit and scope of the invention. For example, a grip 20 that holds a plurality of balls 10 may be fashioned, or a handle may be added to the grip 20 to facilitate holding thereof. Accordingly, it is not intended that the invention be limited, except as by the appended claims.

The invention claimed is:

1. A heated massage ball comprising:

a spherically shaped ball;

a grip body formed as a handheld unit having a massaging side and an opposing bottom side, wherein the massaging side has a first aperture that the ball protrudes out of for massaging wherein the ball is held within the grip body and can rotate freely within the grip body;

a finger hole formed as a second aperture and bottom opening in the bottom side of the grip; whereby a user can eject the ball from the grip body by depressing the ball through the bottom opening a heated conductor electrically heated, the heated conductor extending through the bottom opening and touching the ball for heating by thermal conduction.

2. The heated massage ball of claim 1 wherein the ball is hollow and at least partially filled with liquid, whereby a user can heat the ball in a microwave.

3. The heated ball of claim 1 further comprising:

a heated base;

a base depression snugly receiving the grip body and ball, wherein the heating conductor element heats water when water is present in the base depression, wherein when a user puts the ball unit into the base depression, the ball is heated to present temperature.

4. The heated ball of claim 3, further comprising a display showing the preset ball temperature.

5. The heated ball of claim 3, further comprising a knob for setting the preset ball temperature.

6. The heated ball of claim 3, further comprising a thermocouple in the conductor and wherein a display further indicates the actual temperature of the massage ball.

7. The heated ball of claim 3, further comprising a power button and a power cord.

8. The heated ball of claim 3, wherein the depression is filled with a heating liquid and retains the heating liquid is the heating liquid heated by the heated conductor wherein the ball receives heat by conduction from the heating liquid.

9. The heated ball of claim 8 wherein the heating element does not contact the ball.

10. The heated ball of claim 9 further including:

an induction coil is included within the grip body, the induction coil for heating the ball and electrically connected to two contacts on a bottom side of the grip, and two electrical contacts in the depression of the base, the two electrical contacts electrically connected to the circuit, whereby when the grip body is retained in the depression of the base the electrical contacts of the base make electrical contact to the corresponding contacts of the grip body for supplying power to the induction coil.

11. A heated massage ball comprising:

a spherically shaped ball;

a grip body formed as a handheld unit holding the spherically shaped ball, wherein the ball can rotate freely within the grip; wherein the grip body has a massaging side and an opposing bottom side, wherein the massaging side has a first aperture that the ball protrudes out of for massaging;

a bottom opening in the grip body;

a second aperture in the bottom of the grip formed as a finger hole allowing a user to eject the ball from the grip body by depressing the ball through the finger hole; and an electrically heated conductor extending through the bottom opening and touching the ball for heating by thermal conduction.

* * * * *